US010253586B2

(12) United States Patent
Haugland et al.

(10) Patent No.: US 10,253,586 B2
(45) Date of Patent: Apr. 9, 2019

(54) CUTTING UNIT FOR INTERNAL CUTTING OF TUBING

(71) Applicant: Qinterra Technologies AS, Stavanger (NO)

(72) Inventors: Lasse Haugland, Bryne (NO); Martin Spinnangr, Stavanger (NO)

(73) Assignee: Qinterra Technologies AS, Stavanger (NO)

( * ) Notice: Subject to any disclaimer, the term of this patent is extended or adjusted under 35 U.S.C. 154(b) by 147 days.

(21) Appl. No.: 15/533,086

(22) PCT Filed: Dec. 8, 2015

(86) PCT No.: PCT/NO2015/050241
§ 371 (c)(1),
(2) Date: Jun. 5, 2017

(87) PCT Pub. No.: WO2016/093705
PCT Pub. Date: Jun. 16, 2016

(65) Prior Publication Data

US 2017/0328159 A1 Nov. 16, 2017

(30) Foreign Application Priority Data

Dec. 9, 2014 (NO) ..... 20141488

(51) Int. Cl.
*E21B 29/00* (2006.01)

(52) U.S. Cl.
CPC ..... *E21B 29/005* (2013.01); *E21B 29/002* (2013.01)

(58) Field of Classification Search
CPC ..... E21B 29/005
(Continued)

(56) References Cited

U.S. PATENT DOCUMENTS 134,162 A 12/1872 Patterson et al.
1,632,015 A 6/1927 Ventresca
(Continued)

FOREIGN PATENT DOCUMENTS

CN 2564736 Y 8/2003
EP 2530238 A1 12/2012

*Primary Examiner* — Shane Bomar
(74) *Attorney, Agent, or Firm* — Gable Gotwals

(57) ABSTRACT

This invention relates to a cutting unit for a well pipe. The cutting unit includes a tool housing axially displaceable and rotatable in the well pipe, arranged in the tool housing at least one cutting tool displaceable in a radial direction, the unit connected to a rotary adapter for rotation around a center axis, and the tool housing provided with a leading end portion and a coupling portion, the leading end portion being conical, sloping towards the center axis and away from the coupling portion; and the cutting unit provided with an elongated springable tool mount with a first end portion, a second end portion and a resilient portion between first end portion and second end portion, elongated tool mount positioned in an external recess in the tool housing, and the second end portion positioned at the leading end portion, and the tool mount tensioned towards the center axis; a sleeve positioned around the coupling portion, the first end portion attached to the sleeve; at least one shear body fixing the sleeve to the tool housing; an internal first bevel on the second end portion of the tool mount; a cutting unit attached to the second end portion on the opposite side of the internal first bevel; and a push rod connected to a cone body, cone body resting against the first bevel.

9 Claims, 11 Drawing Sheets

(58) Field of Classification Search
USPC ..... 166/55.7; 30/106
See application file for complete search history.

(56) References Cited

U.S. PATENT DOCUMENTS

| | | | | |
|---|---|---|---|---|
| 1,739,932 | A | 12/1929 | Ercole | |
| 1,927,310 | A | 9/1933 | Edwards | |
| 2,048,530 | A | 7/1936 | Yancey | |
| 2,215,632 | A | 9/1940 | Brack et al. | |
| 2,660,240 | A | 11/1953 | Maurycy | |
| 2,934,147 | A * | 4/1960 | Baker | E21B 29/00 166/298 |
| 2,991,834 | A | 7/1961 | Kennard | |
| 5,722,489 | A * | 3/1998 | Lambe | E21B 10/322 166/269 |
| 7,353,889 | B1 * | 4/2008 | Gunsaulis | F16L 55/1658 166/55.3 |
| 2008/0271892 | A1 * | 11/2008 | Lynde | E21B 29/005 166/298 |
| 2010/0258293 | A1 | 10/2010 | Lynde et al. | |
| 2011/0226474 | A1 * | 9/2011 | Hernandez | E21B 29/005 166/298 |
| 2013/0220615 | A1 | 8/2013 | Drenth | |
| 2013/0233139 | A1 | 9/2013 | Trudeau et al. | |
| 2014/0034317 | A1 | 2/2014 | Hekelaar | |
| 2015/0376966 | A1 * | 12/2015 | Balasubramanian | E21B 29/005 166/298 |
| 2016/0348455 | A1 * | 12/2016 | Haq | E21B 29/005 |
| 2017/0145766 | A1 * | 5/2017 | Hart | E21B 29/005 |
| 2017/0321509 | A1 * | 11/2017 | Hart | E21B 29/005 |
| 2018/0230766 | A1 * | 8/2018 | Johnson | E21B 29/00 |

* cited by examiner

CUTTING UNIT FOR INTERNAL CUTTING OF TUBING

CROSS-REFERENCE TO RELATED APPLICATIONS

This United States application is the National Phase of PCT Application No. PCT/NO2015/050241 filed 8 Dec. 2015, which claims priority to Norwegian Patent Application No. 20141488 filed 9 Dec. 2014, each of which is incorporated herein by reference.

BACKGROUND OF THE INVENTION

This invention relates to a cutting unit for cutting a well pipe. More particularly, it relates to a device in a cutting unit for a well pipe, the cutting unit including a tool housing axially displaceable and rotatable in the well pipe, and there being, arranged in the tool housing, at least one cutting tool displaceable in a radial direction, the cutting unit being connected to a rotary adapter.

In the course of the lifetime of a petroleum well, it may be relevant to cut a well pipe. Best known is the cutting of the well pipe when the well is to be sealed after production has been terminated. It also happens that well pipes in deviated wells have to be cut, which may be very difficult to do with the aid of known equipment.

Known methods for cutting well pipes from the inside include various chipping tools, high-pressure water-cutting, may be with abrasive particles mixed into the water, and the use of abrasive bodies bearing, under rotation, against the inside of the well pipe.

Equipment that makes use of chipping tools generally requires a relatively accurate positioning in the well pipe. These tools are unsuitable for use way down in deviated wells. The use of water-cutting gives little control of how deep into the material the cut is and can easily damage equipment located on the outside of the well pipe that is being cut.

When a well pipe is being cut, the portion of the well pipe that is above the cut may creep downwards because of its weight. A cutting tool which is positioned in the cut may thus get pinched and stuck between the upper portion and the lower portion. When a well pipe is being cut, the upper portion and the lower portion of the well pipe may become horizontally offset relative to each other at the cut. This is known as shear displacement. Shear displacement may happen if the tubing is in compression before being cut, but it may also happen to tubing that is not in compression. A tool which has a portion above and below the cut may thus become clamped between the upper and lower portions of the well pipe.

As mentioned above, there may be equipment on the outside of the tubing. Such equipment may be cables, for example. Especially in deviation wells and horizontal wells, it may be difficult to centre the tool in the well pipe. This may lead to a rotating cutting tool cutting through the tubing wall in a portion facing downwards before the tubing wall has been cut through in a portion facing upwards. It is important that the cutting tool does not continue cutting in the downward-facing portion when the tubing wall has been cut in this portion.

The patent publication EP 2530238 discloses a cutting tool which rotates internally in tubing. An L-shaped cutting arm is hingedly attached to a tool housing and is thus pivotable around a pivot axis. The cutting arm is provided with a cutting tool at its first free end portion. An actuator is in engagement with the second free end portion of the cutting arm. By linear displacement of the actuator, the cutting arm is pivoted around its pivot axis, and the first free end portion is pivoted between a swung-in passive position and a swung-out active position. In the swung-out active position, the cutting tool rests against the inside of the tubing. The tool can be moved into the well by means of a wireline provided with an electrical conductor, possibly by means of a downhole tractor connected to the wireline. The device according to EP 2530238 appears to have an impractical design which may result in damage to equipment located outside the tubing.

The patent publication U.S. Pat. No. 2,991,834 also discloses a cutting tool which rotates inside a pipe around a centre axis. The cutting tool, which consists of a cutting arm with a first cutting end portion, is hingedly attached to a tool housing. The cutting tool is rotatable around the rotational axis, and the rotational axis is positioned at the middle portion of the cutting tool. The cutting tool is guided into its swung-out active position by a sleeve, which is provided with a bevel at its free end, being displaced against the cutting tool on the side of the cutting tool facing the centre axis, so that the first cutting end portion is brought into abutment against the inside of the tubing. The cutting tool is held in place in its swung-in, passive position by a leaf spring which is in engagement with the second end portion of the cutting tool opposite the first cutting end portion. When the first cutting end portion is in its swung-out, active position, the second end portion is swung in towards the centre axis of the cutting tool and the leaf spring is forced inwards towards the centre axis at its one end portion. When the sleeve is moved away from the cutting tool, the leaf spring will pivot the cutting tool back into its passive position.

The patent publication U.S. Pat. No. 2,048,530 also discloses a cutting tool which rotates inside a pipe around a centre axis. At its first, free end portion, a cutting arm is provided with a cutting tool. At its opposite second end portion, the cutting arm is hingedly attached to a tool housing. A leaf spring which is tensioned inwards towards the centre axis rests against the free end portion of the cutting arm, keeping the cutting arm in its passive position. An actuator body with a first portion which has an increasing diameter and with a second portion with a decreasing diameter rests against the side of the cutting arm facing in towards the centre axis. The cutting tool is guided into its swung-out position by the actuator body being moved with its first portion past the cutting arm. When the first portion of the actuator body has been displaced past the cutting arm, the cutting arm is swung back by the cutting arm resting on the second portion of the actuator body and being forced in towards the centre axis by the leaf spring.

The patent publications EP 2530238, U.S. Pat. Nos. 2,991,834 and 2,048,530 have in common that the cutting arm or the cutting tool is hingedly connected to the tool housing. The cutting arm or cutting tool is relatively short. This results in the cutting tool following a course with a relatively short radius through the pipe wall to be cut. This further involves the removal of a relatively large amount of material from the pipe wall compared with a cut following a course perpendicular to the pipe wall, for the pipe to be cut.

The patent publication U.S. Pat. No. 1,739,932 discloses a further cutting tool which rotates internally in a pipe around a centre axis. A cutting arm is provided with the cutting tool at a first end portion. The cutting arm is positioned in a cut-out in the wall of a tool housing and is radially and linearly displaceable in the cut-out. At its second end portion, the cutting arm is provided with a T-shaped projection, and the projection is in engagement with a sleeve-shaped spring body. The spring body is positioned internally in the tool housing. The spring body is tensioned towards the centre axis and keeps the cutting arm in its retracted, passive position. An actuator body with a conical portion is displaced inwards in the sleeve-shaped spring body, and the conical portion forces the cutting arm radially outwards into the active position of the cutting arm. The actuator body is displaced inwards in the sleeve-shaped spring body in a direction from the cutting tool towards the base of the spring body when the cutting arm is activated.

The patent publications U.S. Pat. Nos. 2,991,834, 2,048,530 and 1,739,932 have in common that the tool housing has a cylindrical portion above and below the portion of the pipe that is being cut by the cutting tool. An effect of this is that if the pipe shears as the pipe has been cut, the tool housing will be stuck and great forces will be required for the tool to be pulled free. The tools described are each attached to a drill string. The rotation of the cutting tool is produced by rotating the drill string. A stuck tool is pulled free by the drill string being pulled. The tools described may be used in vertical wells, are less suitable in deviated wells and are unsuitable in horizontal wells.

The invention has for its object to remedy or reduce at least one of the drawbacks of the prior art.

The object is achieved according to the invention through the features which are specified in the description below and in the claims that follow.

According to a first aspect of the invention, a cutting unit for a well pipe is provided, the cutting unit including a tool housing axially displaceable and rotatable in the well pipe. In the tool housing, at least one cutting tool displaceable in a radial direction is arranged. The cutting unit is connected to a rotary adapter for the rotation of the cutting unit around a centre axis. The tool housing is provided with a leading end portion and a coupling portion. The cutting tool is characterized by the leading end portion being conical, sloping towards the centre axis and away from the coupling portion; and by the cutting unit being provided with:

an elongated springable tool mount with a first end portion, a second end portion and a resilient portion between the first end portion and the second end portion, the elongated tool mount being positioned in an external recess in the tool housing, and the second end portion being positioned at the leading end portion, and the tool mount being tensioned towards the centre axis;

a sleeve which is positioned around the coupling portion, the first end portion being attached to the sleeve;

at least one shear body fixing the sleeve to the tool housing;

an internal first bevel on the second end portion of the tool mount;

a cutting unit attached to the second end portion on the opposite side of the internal first bevel; and a push rod connected to a cone body, the cone body resting against the first bevel.

The cutting tool may be made from any suitable material which has a grinding effect on the well pipe when the cutting tool is resting against the inside of the well pipe and is being rotated around the longitudinal axis of the well pipe. For example, the grinding material may contain ceramic abrasive bodies, metallic abrasive bodies or hard, mineral abrasive bodies such as industrial diamonds.

By connecting the cutting tool to the tool housing by means of a springable tool mount, a force that has the effect of moving the cutting tool back towards its initial position will always be present.

The cutting tool may be wedge-shaped with a cutting tip and arranged to form a, viewed in cross section, wedge-shaped, encircling, internal groove in the well pipe.

The mounting geometry of the springable tool mount contributes to one side of the groove in the well pipe being curved, viewed in cross section; see the special part of the document. A, viewed in cross section, curved side of the groove which is formed during the grinding chipping of the cutting tool against the well pipe contributes to a better clearance between the cutting tool and the groove of the well pipe, whereby the retraction of the cutting tool towards a passive position after cutting is facilitated, even if the separated pipe parts should become displaced relative to each other or be pressed together because the pipe is in compression.

To limit the depth of the cut, a restricting face may be arranged in association with the cutting tool or the tool mount. The restricting face is arranged in such a way that it will strike against the inside of the well pipe when this has been cut or just before the well pipe has been cut. The restricting face prevents the cutting tool from being moved further outwards, so that damage cannot be caused to adjacent components.

In a deviation well, because of gravity, the cutting tool will have a greater rate of chipping in a downward-facing portion of the well pipe than in an upward-facing portion. The restricting face prevents further cutting of the downward-facing portion of the well pipe when this portion has been completely cut, whereas cutting may continue in the upward-facing portion of the well pipe until this portion, too, is completely cut.

The tool mount and the sleeve may be formed of one piece of material.

The cone body may be connected to an actuator which is arranged to displace the cone body towards an active position. A compression spring may be arranged to tension the cone body in the direction of a passive position. The cone body is thus displaced towards its initial position even if the hydraulic or electrical energy to the actuator should be lost. In addition to the compression spring, the springable tool mount which is tensioned towards the centre axis will contribute to the displacement of the cone body towards its passive position as well.

The tool housing may be provided with a transition between a longitudinal external ridge and the leading, conical end portion. The cutting tip may be provided with a side face facing the end portion. In an axial direction, the side face may be positioned at the transition. It is thereby achieved that the tool housing tapers towards the leading portion which extends beyond the groove formed in the well pipe.

The rotary adapter and thereby the cutting unit may be connected to a wireline tractor. The rotary adapter may be supplied with electrical energy by means of a wireline provided with an electrical conductor, or the wireline tractor may be supplied with electrical energy by means of a wireline provided with an electrical conductor.

The tool mount may be provided with a second bevel which is arranged to strike against a third bevel when the tool mount is being displaced axially relative to the tool housing. The third bevel is in the tool housing and the second and third bevels are inclined in the same direction. The cutting tool is moved radially towards its initial position when the second bevel is moved along the third bevel in the direction of the leading end portion.

Is such a displacement to take place, a shear body which is arranged to prevent axial displacement of the tool mount relative to the tool housing must be broken. If the cutting tool should be stuck in the well pipe, a sufficiently large axial force for the shear body to break or shear may be applied to the tool housing. The tool mount is thereby displaced as described, whereby the cutting tool is brought into its initial position. The cutting unit may then be pulled away from the cutting place.

The leading end portion of the tool housing has a conical shape. It is thereby ensured that the cutting unit may be pulled out of the cutting place by means of a relatively small force, even if the two parts of the well pipe should shear after the cut.

A cutting tool which is arranged to cut a well pipe by rotating around the longitudinal axis of a cutting unit is described as well. The cutting tool includes a wedge-shaped cutter projecting radially in its position of application and having a cutting tip, and the cutting tool includes a restricting face.

The restricting face may be angled relative to a cutting face which extends from the restricting face to the cutting tip. The cutting tool may be provided with a threaded bore oriented axially in the position of application.

A method of cutting a well pipe by means of a cutting unit is described as well, the cutting unit including a tool housing axially displaceable and rotatable in the well pipe, and there being, arranged in the tool housing, at least one cutting tool displaceable in a radial direction, the cutting unit being connected to a rotary adapter, and the method including:

connecting the cutting tool to the tool housing by means of a relatively elongated springable tool mount;

letting a cone body rest against a first bevel on the tool mount; and while rotating the cutting unit in the well pipe, displacing the cone body in an axial direction to bring the cutting tool from a passive, radially retracted position into an active, radially extended position.

The device and the method according to the invention provide a cutting tool which helps to ensure that an internal cutting groove of even depth is formed in the well pipe even if the well pipe is at an angle relative to the vertical direction. The cutting tool exhibits advantageous features with respect to allowing easy release from the cutting place even if unforeseen events should occur.

In what follows, examples of preferred embodiments and methods are described, which are visualized in the accompanying drawings, in which:

FIG. 1 shows a first embodiment of a cutting unit according to the invention in a side view;

FIGS. 2A-B show a side view and an end view of the cutting unit in the first embodiment on a larger scale, the cutting tools of the cutting unit being in a radially retracted, passive position;

FIG. 3 shows a longitudinal section of the cutting unit on the same scale as FIG. 2, the cutting tools of the cutting unit being in a radially retracted, passive position;

FIGS. 4A-C show, on the same scale as FIG. 2, a side view and an end view of the cutting unit, in which the cutting tools of the cutting unit are in a radially extended, active position, and an end view, in which the cutting unit is positioned in a well pipe;

Figure 1:
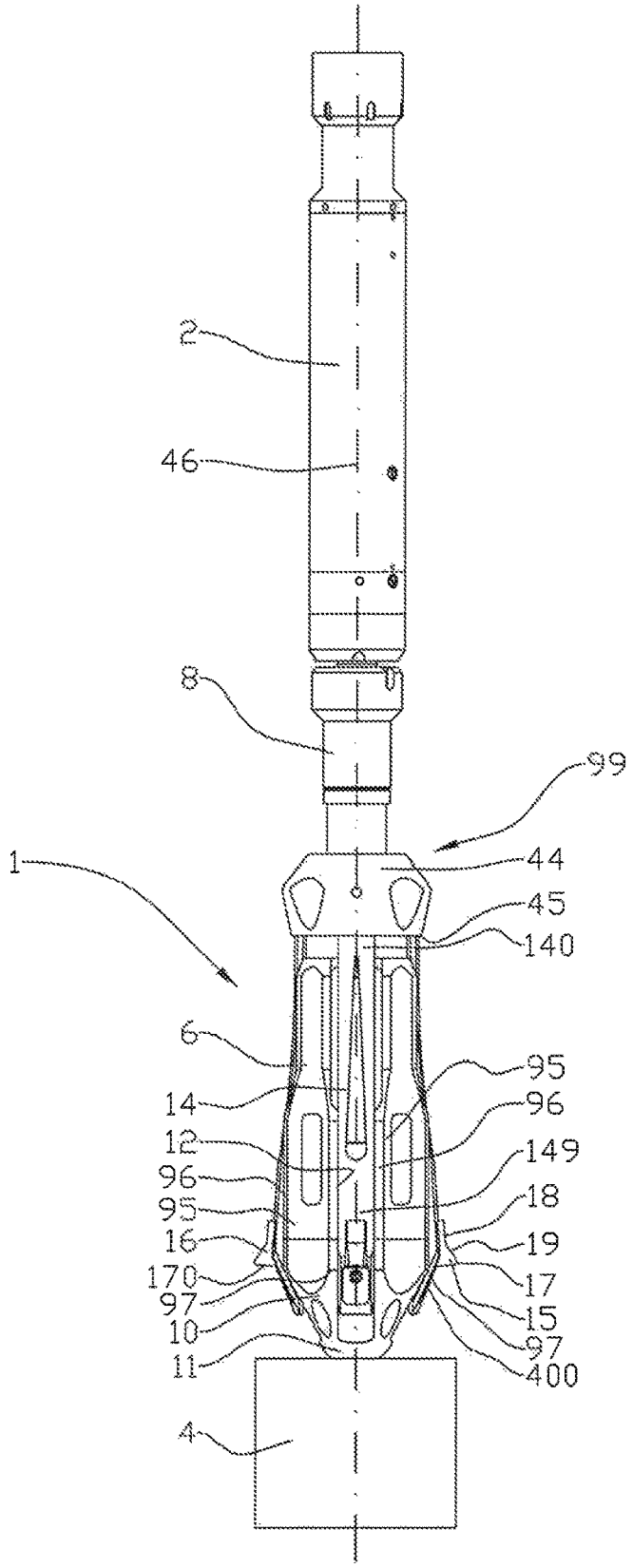
Figure 2A:
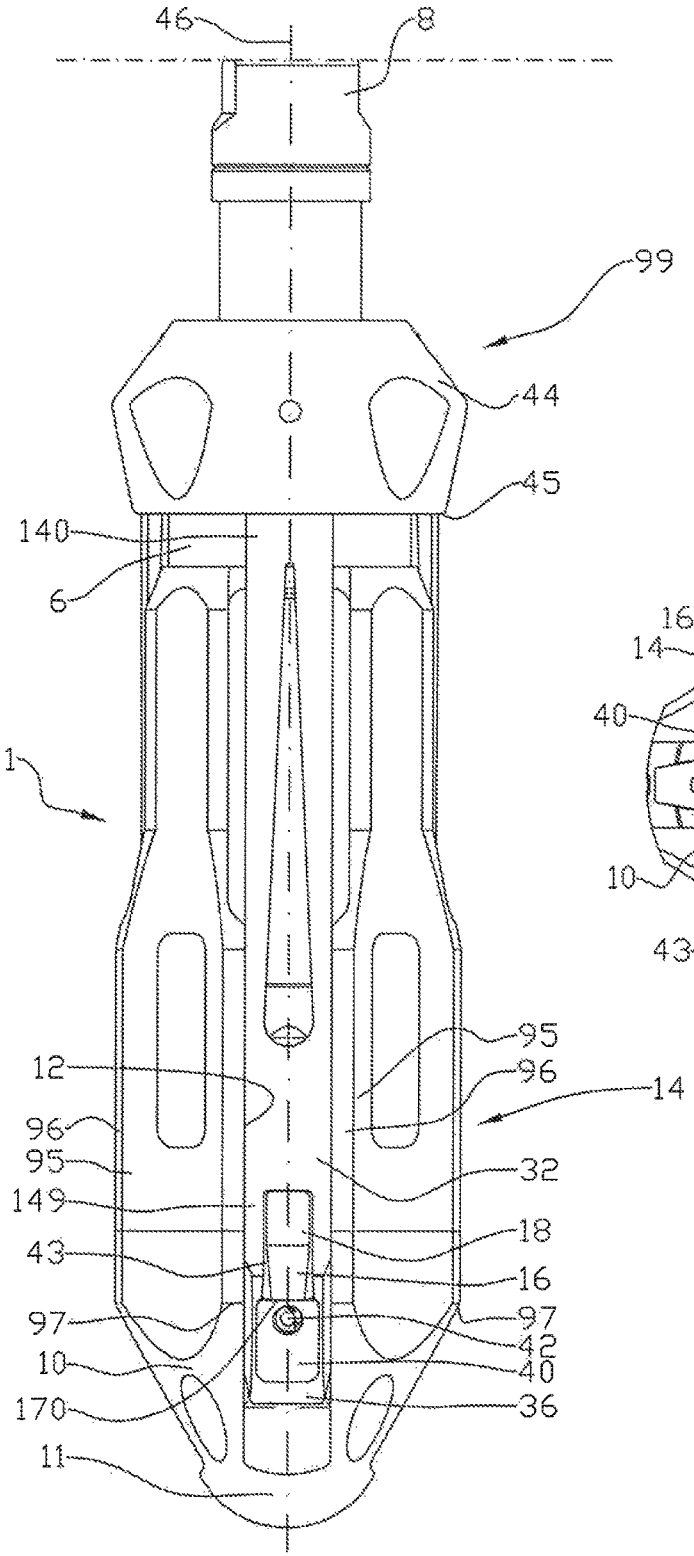
Figure 2B:
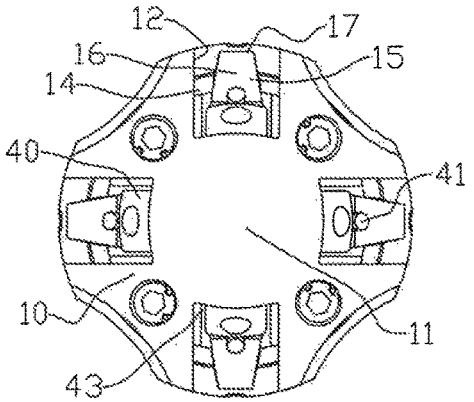

In the drawings, the reference numeral 1 indicates a cutting unit which is connected to a rotary adapter 2 and has been run into a well pipe 4 in the ground.

The cutting unit 1 includes a tool housing 6 which is connected to the rotary shaft 8 of the rotary adapter 2 at a coupling portion 99. At its opposite, leading end portion 10 the tool housing 6 has been given a conical shape, and the leading end portion 10 is terminated in a rounded leading portion 11. On its outside, the tool housing 6 is formed with longitudinal, axially oriented recesses 12. In the figures, four recesses 12 are shown. The recesses 12 are formed between longitudinal, axial ribs 95 on the outside of the tool housing 6. Each rib 95 forms a ridge 96 radially in the longitudinal direction of the rib 95. The ridge 96 functions as a guide for the cutting unit 1 when this is displaced in the well pipe 4. The ridge 96 may be parallel to the centre axis 46 of the cutting unit 1. In an alternative design, the radial distance of the ridge 96 to the centre axis 46 may increase from the coupling portion 99 of the tool housing 6 towards the leading end portion 10 of the tool housing 6. In a first embodiment as shown in FIGS. 1-5, the ridge 96 forms a marked transition 97 at the transition to the conical end portion 10. In a second embodiment as shown in FIGS. 6-10, the ridge 96 forms a rounded transition 97' at the transition to the conical end portion 10.

The rotary adapter 2 and thereby the cutting unit 1 may be connected to a wireline tractor (not shown). In one embodiment, the rotary adapter 2 may be supplied with electrical energy by means of a wireline provided with an electrical conductor (not shown). In an alternative embodiment, the wireline tractor may be supplied with electrical energy by means of a wireline provided with an electrical conductor. The wireline tractor may drive the rotary adapter 2.

In each of the recesses 12, an elongated tool mount 14 is arranged for a respective cutting tool 16. The elongated tool mount 14 has a first end portion 140 and a second end portion 149. The cutting tool 16 is attached to the second end portion 149.

The cutting tool 16 includes ceramic abrasive bodies, metallic abrasive bodies or hard, mineral abrasive bodies, not shown, such as industrial diamonds. The cutting tool 16 is formed with a restricting face 18 and with a cutter 15 projecting radially in a position of application. The cutter 15 tapers off in a direction radially outwards into a cutting tip 17. The cutter 15 is thus wedge-shaped as shown in the figures. Between the restricting face 18 and the cutting tip 17, the cutter 15 forms a cutting face 19. The cutting face 19 is angled relative to the restricting face 18. The cutting tip 17 is provided with a side face 170 facing the end portion 10. In one first embodiment as shown in FIGS. 2-5, the cutting tool 16 is provided, in the side face 17 thereof, with a threaded bore 41 oriented axially in the position of application.

The cutting tool 16 is attached to the tool mount 14 in a groove 43 in the second end portion 149. The cutting tool 16 is slid axially into the groove 43. The cutting tool 16 is held in place in the groove 43 by means of a clamp 40 and a clamping bolt 42. The clamp 40 is provided with a bevel 400 sloping towards the leading end portion 10.

The clamp 40 prevents the cutting tool 16 from being unintentionally displaced out of the groove 43. A replacement of the cutting tool 16 is done by first loosening the clamp 40. If necessary, a draw bolt (not shown) may be screwed into the bore 41 to make it easier to pull the cutting tool 16 axially out of the groove 43.

A push rod 20, stopping against an actuator 22 in the rotary adapter 2, partially extends in a bore 24 in the tool housing 6, as shown in FIGS. 3, 5, 7-10. The push rod 20 is connected to a cone body 26 resting against a first bevel 28 on the inside of each tool mount 14 in the second end portion 149. A compression spring 30 is placed in tension between the cone body 26, on the opposite side relative to the push rod 20, and the leading portion 11.

Figure 3:
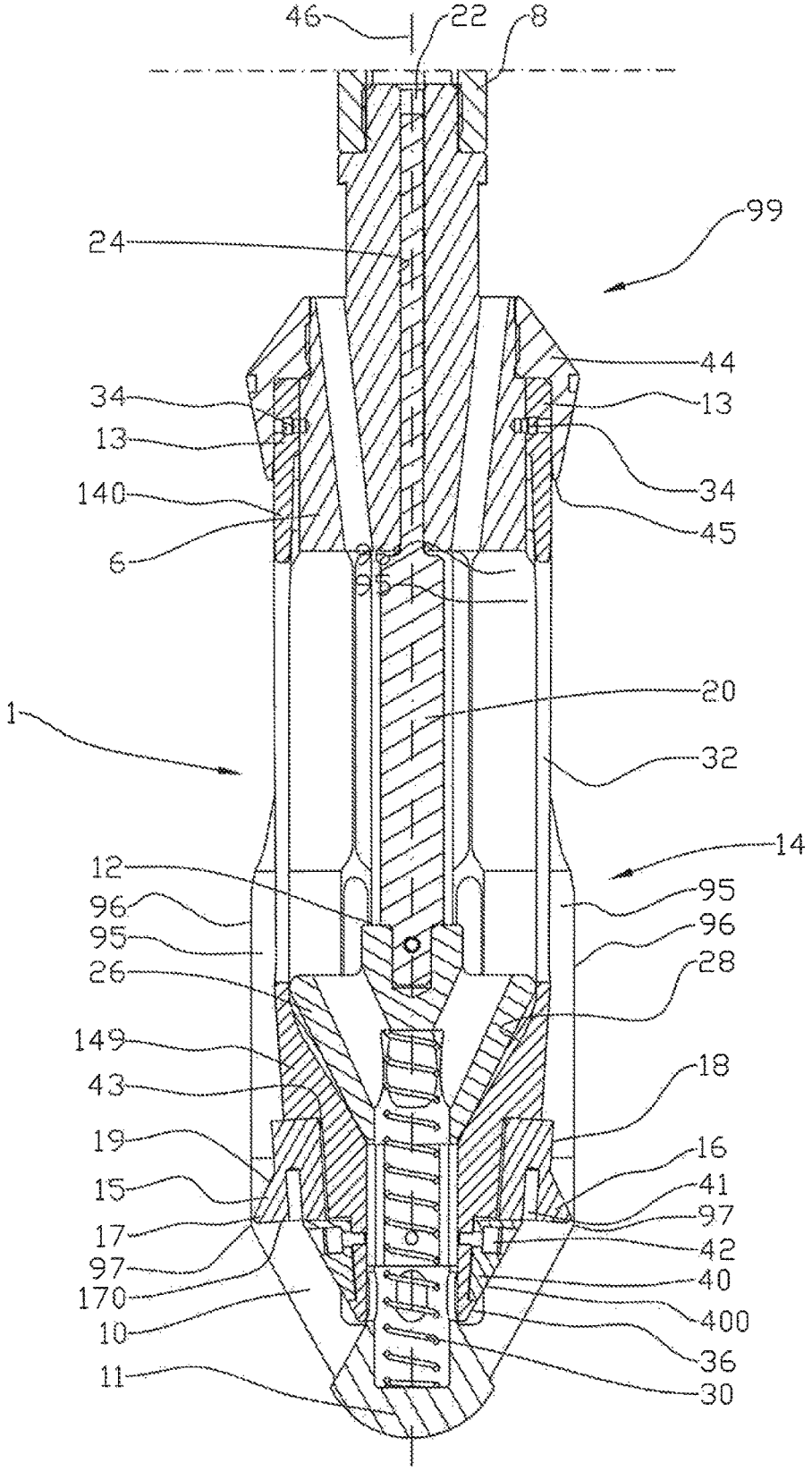
Figure 5:
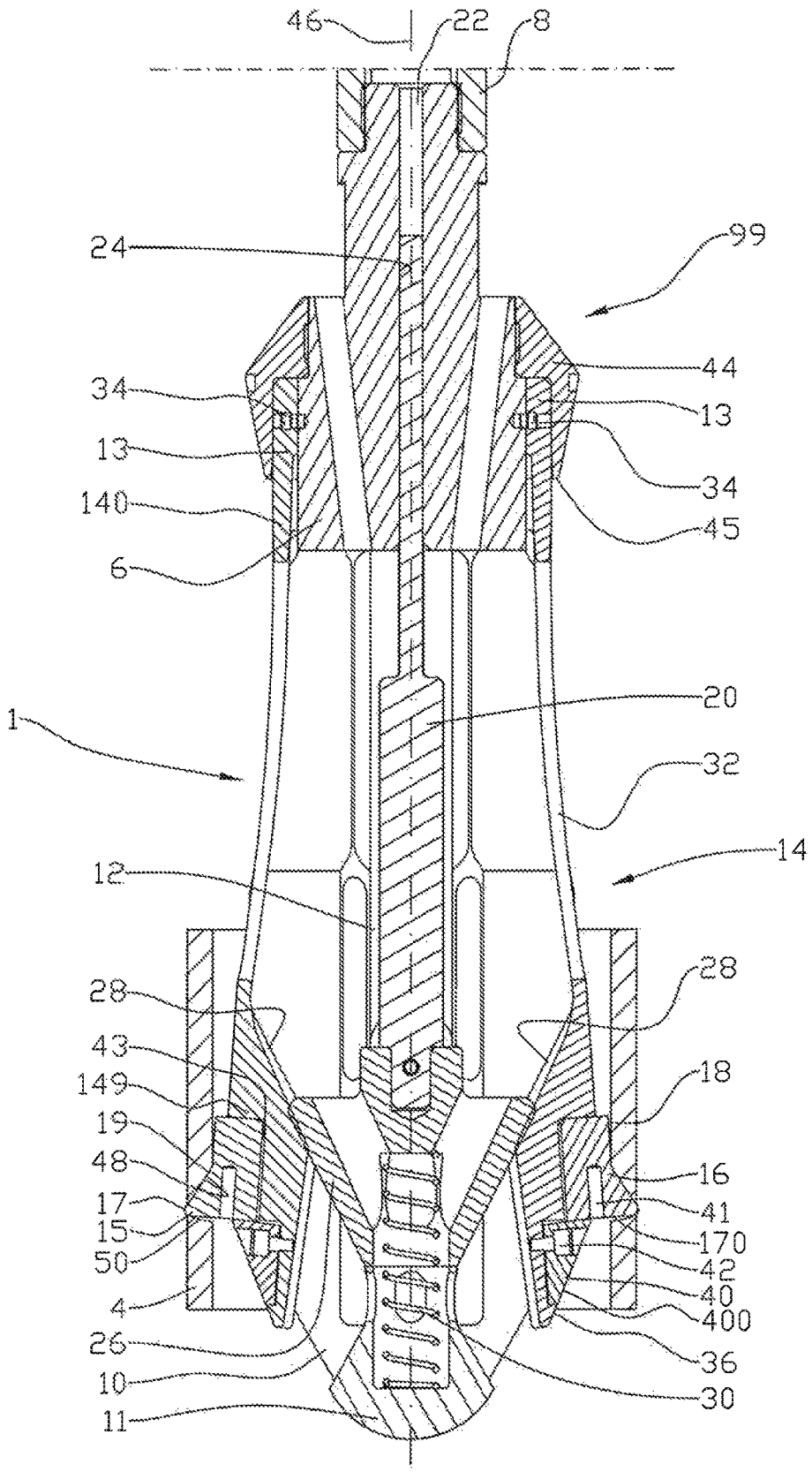
FIG. 5 shows a longitudinal section on the same scale as FIG. 2 of the cutting unit placed in a well pipe, the cutting tools of the cutting unit being in a radially extended, active position.
Figure 6:
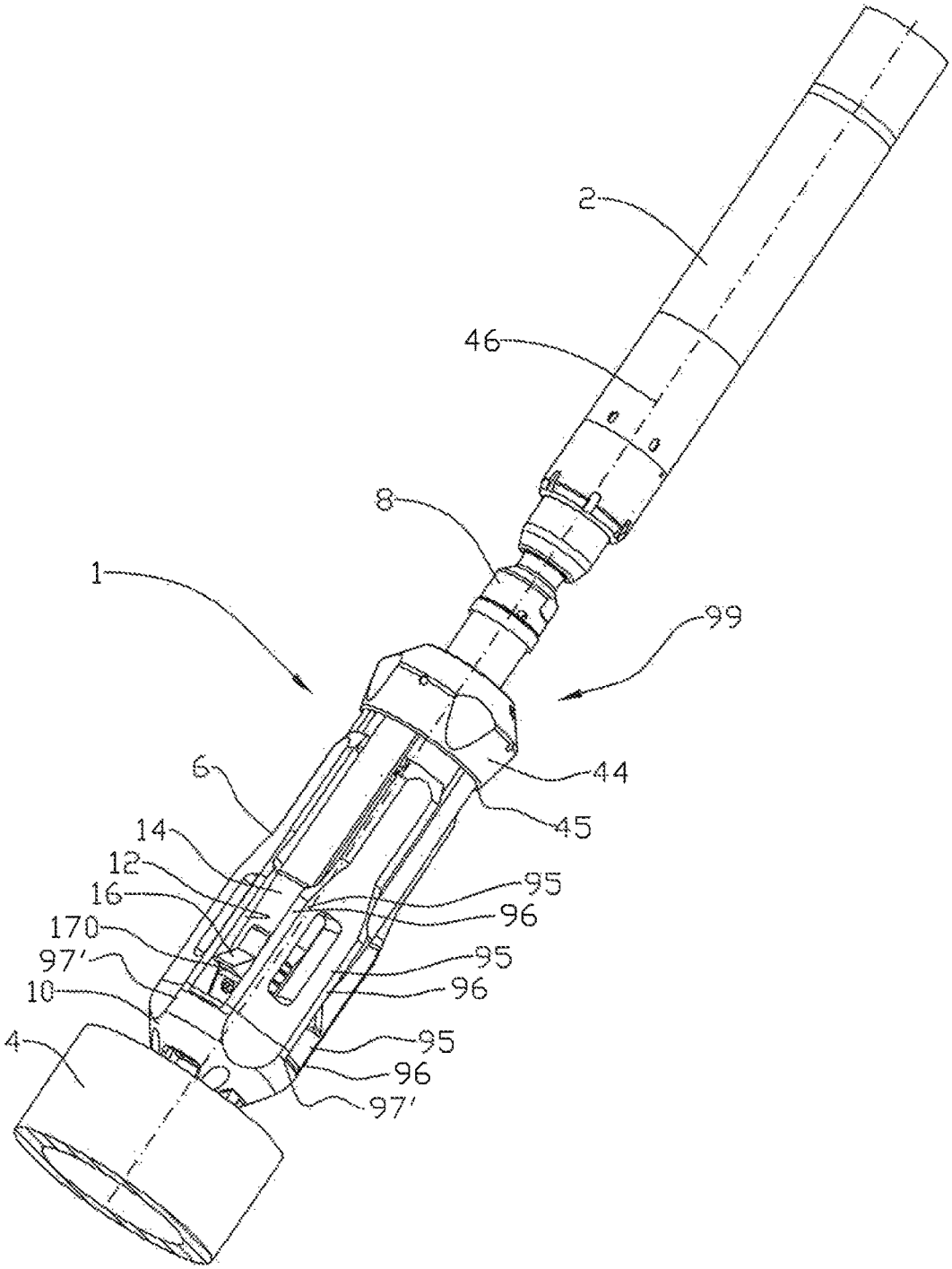
FIG. 6 shows a second embodiment of a cutting unit according to the invention in perspective.
Figure 7:
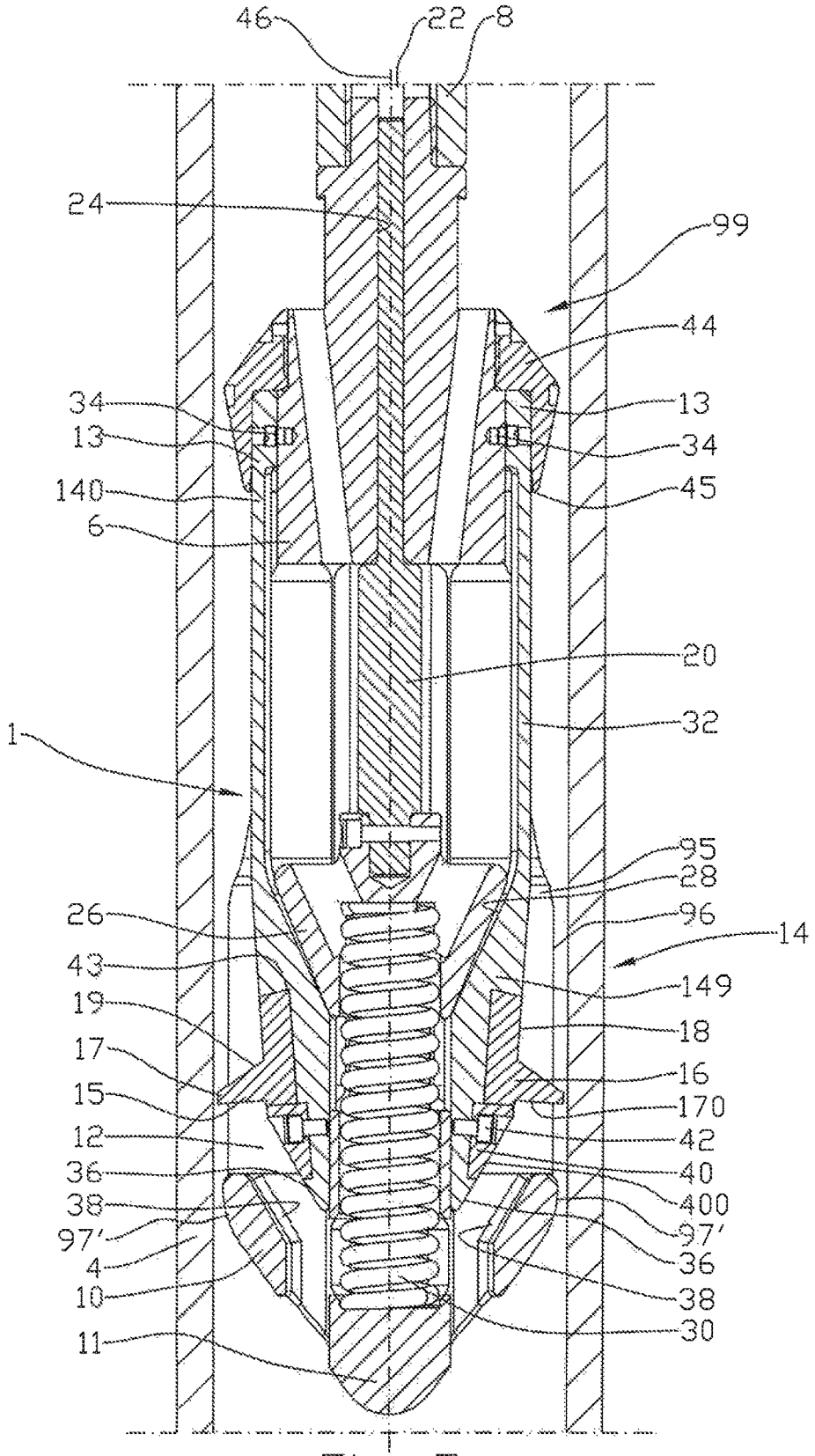
FIG. 7 shows a longitudinal section on a larger scale of the cutting unit in the second embodiment positioned in a well pipe, the cutting tools of the cutting unit being in a radially retracted, passive position.

Each of the tool mounts 14 is formed with a longitudinal, resilient portion 32 extending from the first end portion 140. The resilient portion 32 is tensioned towards the centre axis 46 of the cutting unit 1. The first end portion 140 is attached to a sleeve 13. The sleeve 13 and the tool mounts 14 with their respective resilient portions 32 may be formed of one piece of material. The sleeve 13 is attached to the tool housing 6 by means of at least one shear body 34. In FIGS. 3, 5 and 7, two shear bodies 34 are shown.

In an alternative embodiment (not shown), the restricting face 18 is separate from the cutting tool 16. The restricting face 18 is in association with the elongated, resilient portion 32 of the tool mount 14, so that the restricting face 18 faces radially outwards.

In the second embodiment shown, the second end portion 149 is provided, at its free end, with an external, second bevel 36 which is arranged to cooperate with an internal, third bevel 38 in the leading end portion 10 of the tool housing 6, see FIGS. 7-10.

A guide ring 44 has been slid over the tool housing 6 and the tool mounts 14 at the sleeve 13 at the coupling portion 99. The guide ring 44 forms an edge 45 facing towards the leading end portion 10.

The leading end portion 10 of the cutting unit 1 is conically shaped so that the portion between the cutter 15 and the leading portion 11 is sloping towards the leading portion 11 and the centre axis 46. The sloping portion 400 of the clamp 40 is sloping inwards towards the centre axis 46 as well. In the first embodiment that is shown in FIGS. 1-5 and 11, the leading end portion 10 between the cutter 17 and the leading portion 11 will slope towards the centre axis 46. The side face 170 of the cutter 17 is positioned just by and over the transition 97 of the rib 95 towards the end portion 10, see FIG. 3. By over is meant on the side facing towards the coupling portion 99.

Figure 8:
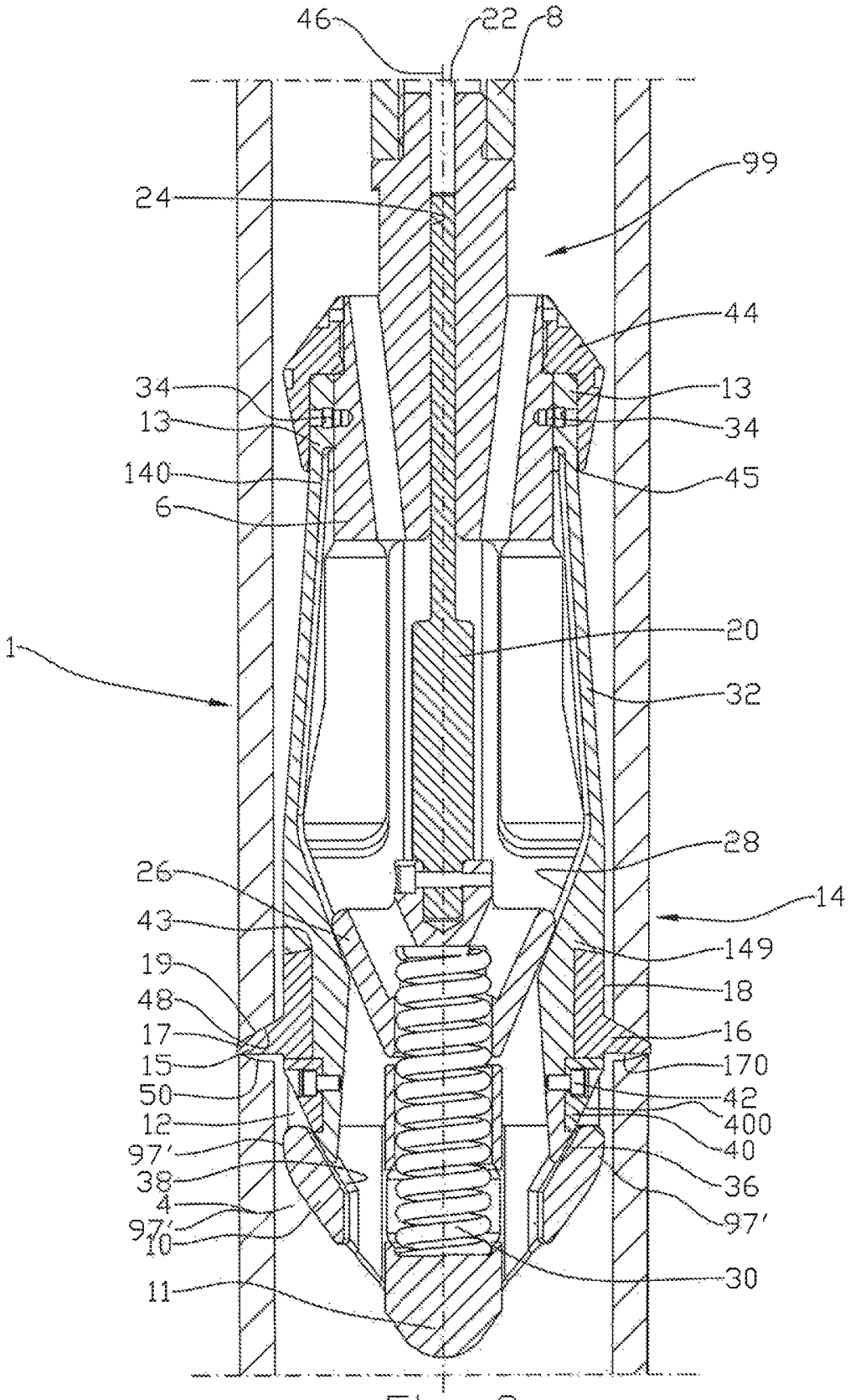
FIG. 8 shows the same as FIG. 7, but the cutting tools are in a radially extended position.
Figure 9:
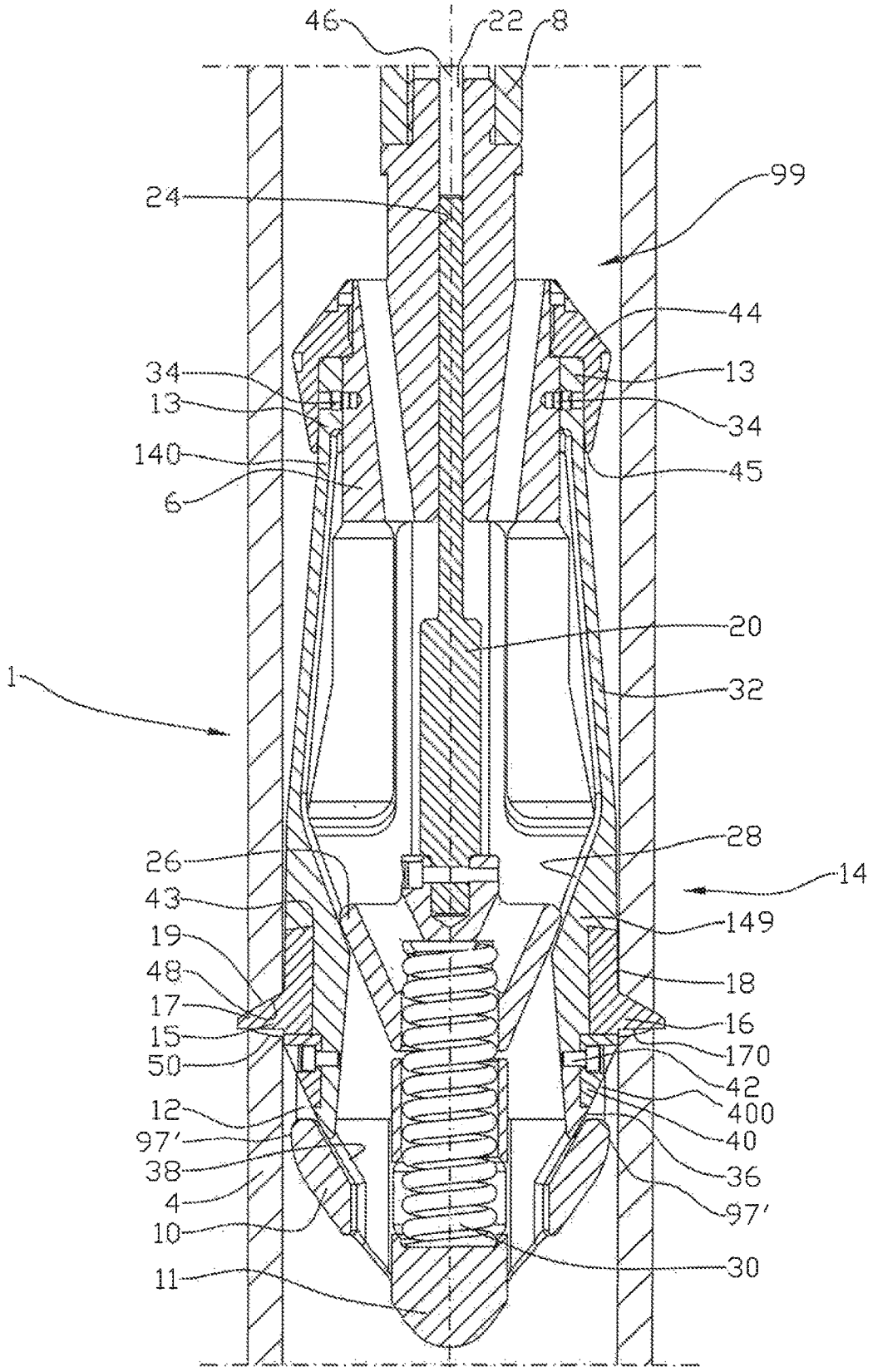
FIG. 9 shows the same as FIG. 7, but the restricting faces of the cutting unit have struck the inside of the well pipe.

In the second embodiment that is shown in FIGS. 6-10, the leading end portion 10 of the cutting unit 1 is conically shaped as well. In the longitudinal direction of the cutting unit 1, the rounded transition 97' is positioned at the second bevel 36 of the tool mount 14. There is thus a distance between the edge face of the cutter 17 facing towards the leading portion 11 and the rounded transition 97', and the distance approximately corresponds to the length of the clamp 40 in the longitudinal direction of the cutting unit 1, as shown in FIGS. 7-9. The sloping portion 400 of the clamp 40 forms an extension of the second external bevel 36 of the tool mount 14.

When the well pipe 4 is to be cut, the cutting unit 1 and the rotary adapter 2 are moved into the well pipe 4 to a desired cutting position. During rotation of the cutting unit 1 around its centre axis 46, the actuator 22 is brought to displace the push rod 20 and the cone body 26 in the direction of the leading end portion 10. At the same time, the compression spring 30 is tensioned.

By the very fact of the cone body 26 resting against the first bevel 28, this axial displacement of the cone body 26 has the effect of making the cutting tool 16 be moved radially outwards until the cutting tip 17 strikes against the inside of the well pipe 4.

An internal, wedge-shaped groove 48 is thereby ground into the well pipe 4 as the cutting tool 1 rotates, see FIGS. 8-11.

Figure 4A:
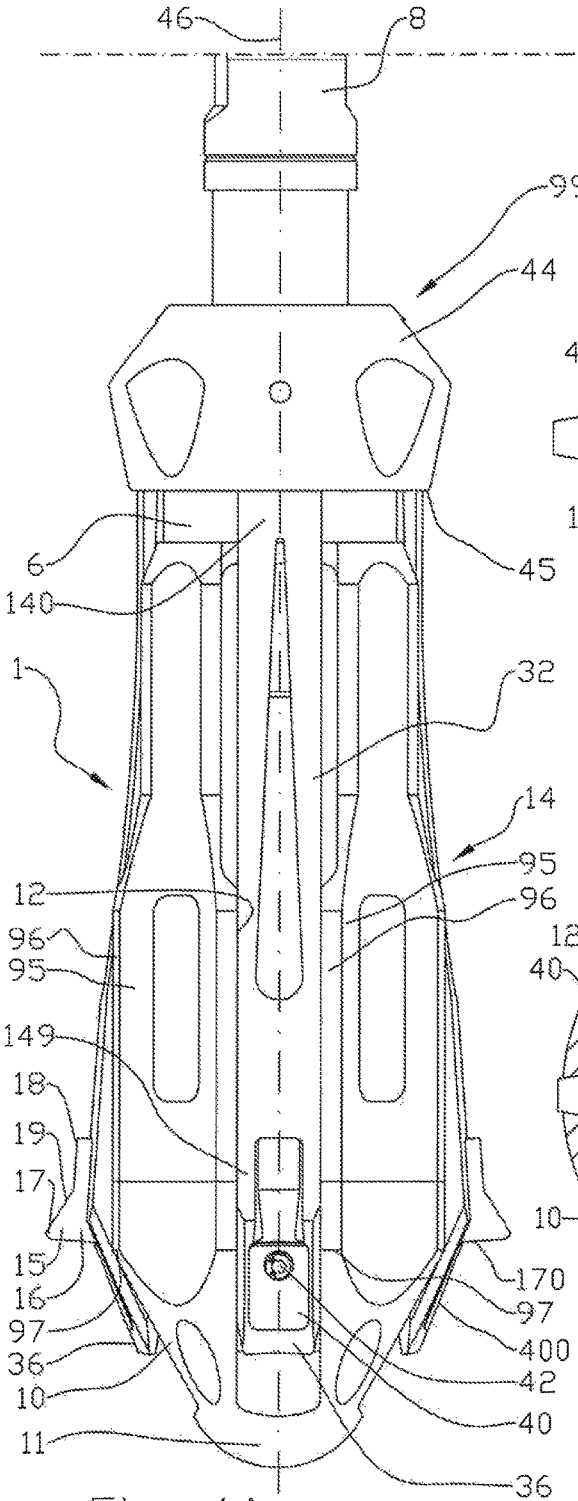
Figure 4B:
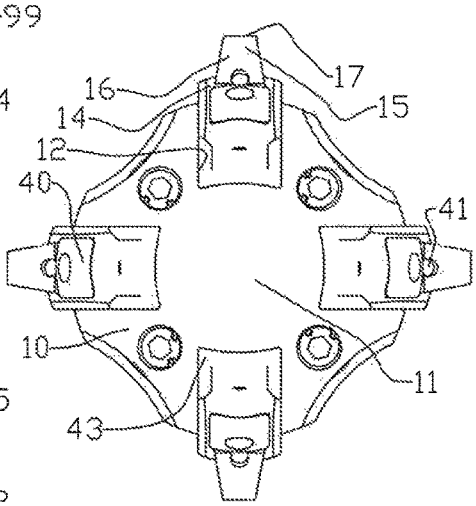
Figure 4C:
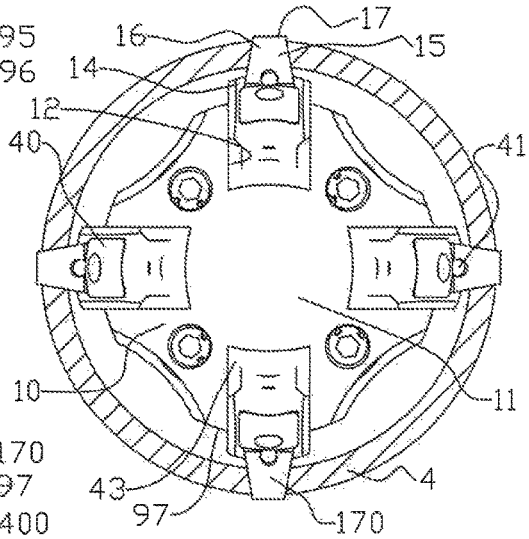

The axial displacement of the cone body 26 also has the effect of the resilient portion 32 of each tool mount 14 projecting from the recess 12 at the second end portion 149 as shown in FIGS. 4A, 5, and 9. The outward axial displacement of the resilient portion 32 increases the tensioning of the resilient portion in towards the centre axis 46.

Figure 11:
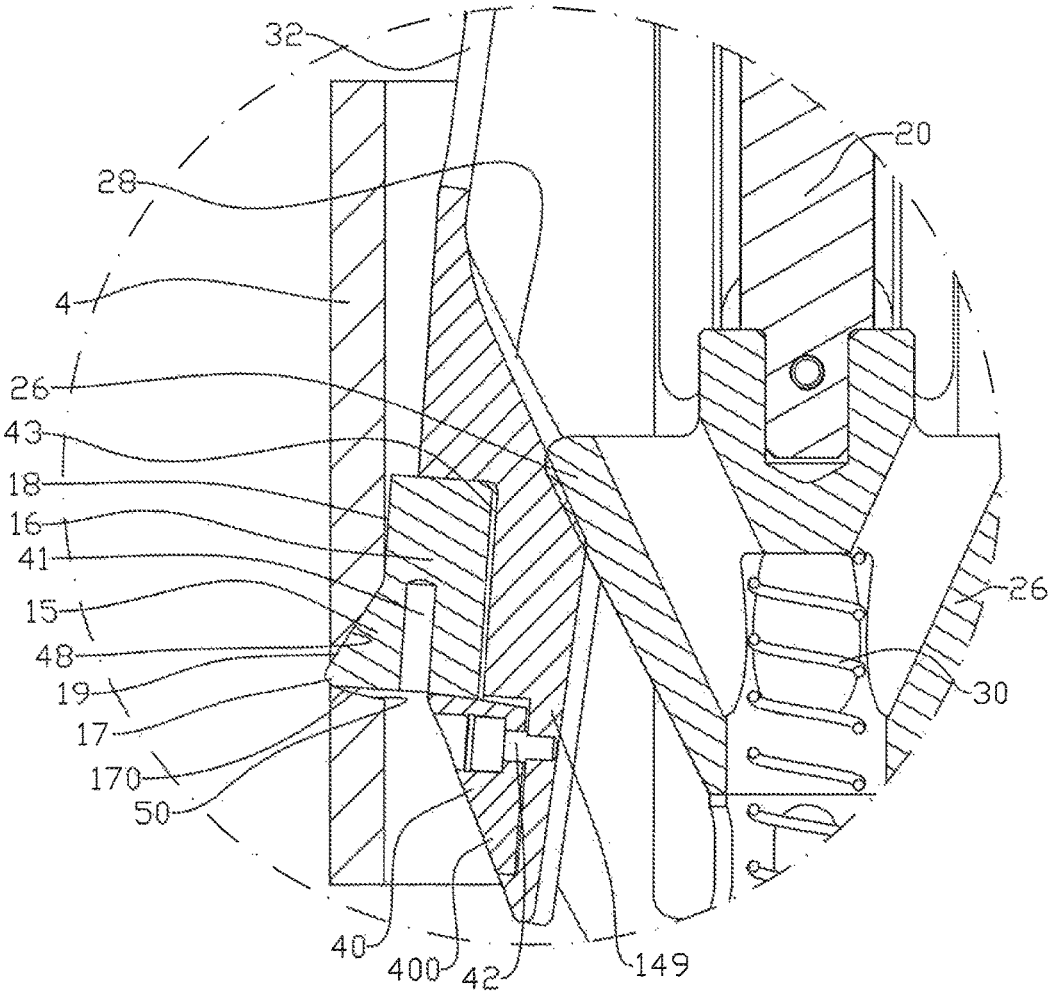
FIG. 11 shows a detail of FIG. 5 at the cut in a pipe wall, on a larger scale.

Because of the attachment of the tool mount 14 in the tool housing 6 and the elongated resilient portion 32, the cutter 15, in a cross-sectional view, forms a curved face 50 in the groove 48, see FIG. 11. The curved face 50 makes a clearance exist between the groove 48 and the cutter 15 of the cutting tool 16. This contributes to the cutting tool 16 being more easily displaceable into its passive, retracted position.

The wedge-shaped groove 48 is shown in greater detail in FIG. 11. The radius of the curved face 50 substantially corresponds to the distance from the cutting tip 17 to the edge 45 of the guide ring 44. The space between the curved face 50 and the side face 170 should be the smallest possible to achieve an effective operation. Cutting a well pipe 4 with a rotating cutting tool 16 may take several hours. It is therefore beneficial that as little material as possible has to be removed from the pipe wall by grinding. This is achieved by the curved face 50 having a large radius. This has been achieved with the present invention. Had the cutting tip 17 followed a small radius, for example by the cutting tool 16 being attached to a hinged tool mount with a pivot axis near the cutting tool 16, more material would have had to be removed and the operation would have taken a longer time.

When the desired cutting depth has been achieved, the restricting face 18 will strike against the inside of the well pipe 4, preventing the cutter 15 of the cutting tool 16 form working its way further into the well pipe 4.

When the cutting operation has been carried out, the rotary adapter 2 is stopped. The compression spring 30 displaces the cone body 26 towards its initial position, whereby the resilient portions 32 move the respective cutting tools 16 into their respective passive positions. The resilient portion 32, which is tensioned towards the centre axis 46 will press against the cone body 26 via the first bevel 28 and cooperate with the compression spring 30 to displace the cone body 26 towards its initial position.

Figure 10:
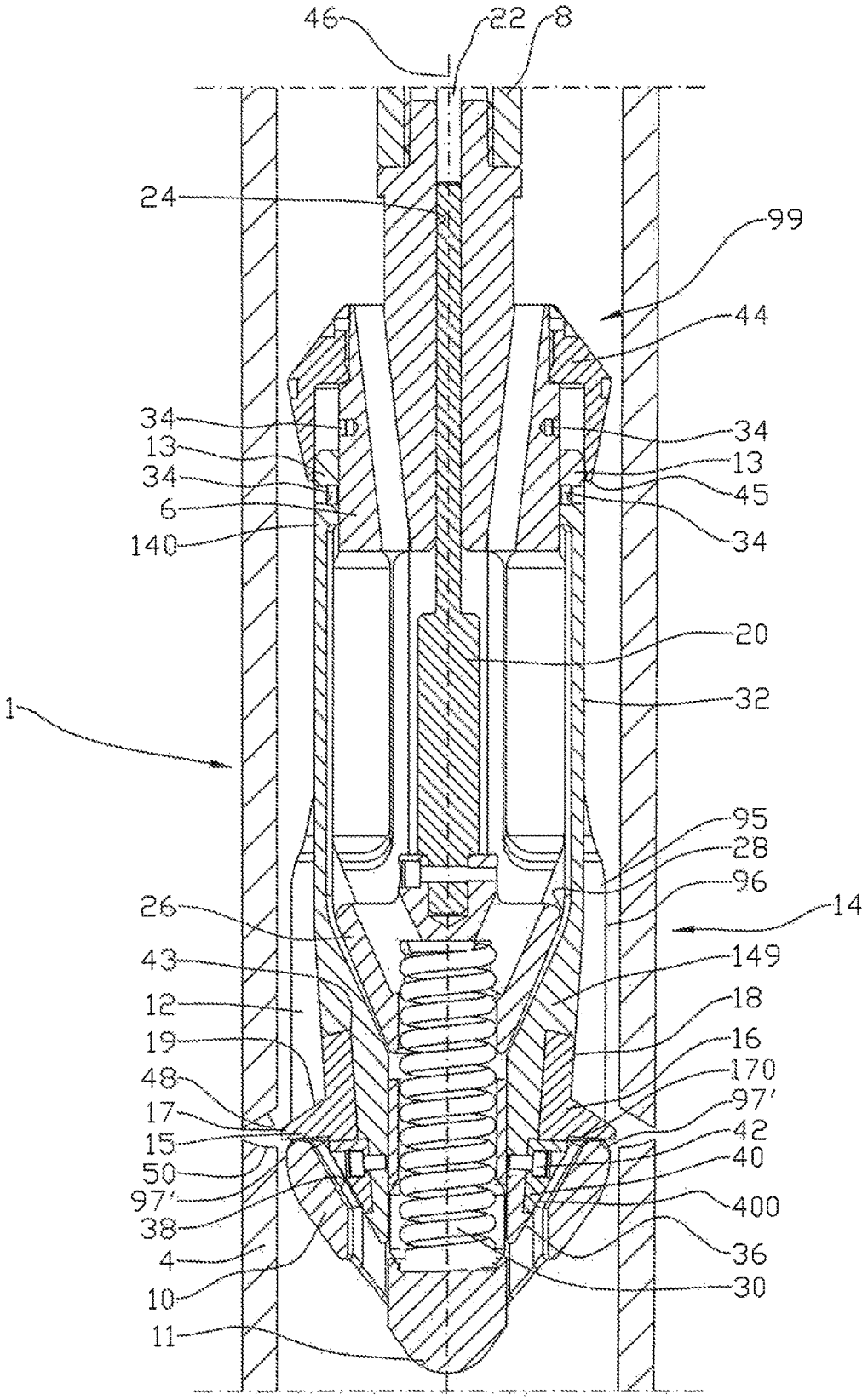
FIG. 10 shows the cutting tool after the cutting tool has been pulled radially inwards by means of an axial displacement of the tool mount of the cutting unit relative to the tool housing of the cutting unit.

Should one or more of the cutting mounts 14 with cutting tools 16 have got stuck in their active extended positions, the shear body 34 may be ruptured by pulling the tool housing 6 and the rotary adapter, possibly also the wireline tractor, in the direction of the rotary adapter 2. According to both the first embodiment and the second embodiment, the sleeve 13 will be displaced along the tool housing 6 until the lower edge of the sleeve strikes the ribs 95. In the second embodiment, the second bevels 36 of the tool mounts 14 will additionally be moved towards the third bevel 38 in the tool housing 6 when the tool housing 6 is displaced in the direction of the rotary adapter 2. This will have the effect of the tool mounts 14 and the cutting tools 16 being displaced radially inwards at relatively great force. The sloping portion 400 cooperates with the internal, third bevel 38 when the tool mount 14 is displaced towards the leading end portion 10, as shown in FIG. 10.

Should the well pipe 4 shear when the groove 48 penetrates the entire circumference of the well wall, the lower part of the well pipe 4 will press against the tool housing 6 between the cutter 15 and the leading portion 11, see FIG. 5. Because of the sloping portion 400 of the clamp 40 and the conically shaped end portion 10, together forming a relatively smooth, conical surface, see FIGS. 4A, 5, the pressure from the lower part of the well pipe 4 will displace the cutting unit 1 in the direction of the rotary adapter 2. This prevents the cutting unit 1 from sticking in the severed well pipe 4.

It should be noted that all the above-mentioned embodiments illustrate the invention, but do not limit it, and persons skilled in the art may construct many alternative embodiments without departing from the scope of the dependent claims. In the claims, reference numbers in brackets are not to be regarded as restrictive. The use of the verb "to comprise" and its different forms does not exclude the presence of elements or steps that are not mentioned in the claims. The indefinite article "a" or "an" before an element does not exclude the presence of several such elements. The fact that some features are indicated in mutually different dependent claims does not indicate that a combination of these features cannot be used with advantage.

The invention claimed is:

1. A cutting unit (1) for a well pipe (4), the cutting unit (1) including a tool housing (6) axially displaceable and rotatable in the well pipe (4), and there being, arranged in the tool housing (6), at least one cutting tool (16) displaceable in a radial direction, the cutting unit (1) being connected to a rotary adapter (2) for the cutting unit (1) to be rotated around a centre axis (46), and the tool housing (6) being provided with a leading end portion (10) and a coupling portion (99), said cutting unit comprising:

the leading end portion (10) is conical, sloping towards the centre axis (46) and away from the coupling portion (99); and an elongated springable tool mount (14) with a first end portion (140), a second end portion (149) and a resilient portion (32) between the first end portion (140) and the second end portion (149), the elongated tool mount (14) being positioned in an external recess (12) in the tool housing (6), and the second end portion (149) being positioned at the leading end portion (10), and the tool mount (14) being tensioned towards the centre axis (46);

a sleeve (13) which is positioned around the coupling portion (99), the first end portion (140) being attached to the sleeve (13);

at least one shear body (34) fixing the sleeve (13) to the tool housing (6);

an internal first bevel (28) being on the second end portion (149) of the tool mount (14);

a cutting unit (16) attached to the second end portion (149) on a opposite side of the internal first bevel (28); and a push rod (20) connected to a cone body (26), the cone body (26) resting against the first bevel (28).

2. The cutting unit (1) according to claim 1, wherein a cutter (15) of the cutting tool (16) is wedge-shaped with a cutting tip (17) and arranged to form a, viewed in cross section, wedge-shaped groove (48) in the well pipe (4).

3. The cutting unit (1) according to claim 1, wherein a restricting face (18) in association with the cutting tool (16) is arranged to strike against a inside of the well pipe (4) before or when the well pipe (4) has been cut.

4. The cutting unit (1) according to claim 1, wherein a restricting face (18) in association with the tool mount (14) is arranged to strike against a inside of the well pipe (4) before or when the well pipe (4) has been cut.

5. The cutting unit (1) according to claim 1, wherein the tool mount (14) and the sleeve (13) is formed of one piece of material.

6. The cutting unit (1) according to claim 1, wherein the cone body (26) is connected via the push rod (20) to an actuator (22) arranged to displace the cone body (26) towards an active position.

7. The cutting unit (1) according to claim 1, wherein a compression spring (30) tensions the cone body (26) in a direction of a passive position.

8. The cutting unit (1) according to claim 1, wherein the tool housing (6) is provided with a transition (97) between a longitudinal external ridge (96) and the leading end portion (10), a cutting tip (17) being provided with a side face (170) facing the end portion (10), and the side face (170) being positioned at the transition (97).

9. The cutting unit (1) according to claim 1, wherein the rotary adapter (2) is connected to a wireline tractor.

* * * * *